United States Patent [19]

Otani

[11] 3,987,619

[45] Oct. 26, 1976

[54] VISUAL TIME INDICATOR

[75] Inventor: Tadashi Otani, Tokyo, Japan

[73] Assignee: Kabushiki Kaisha Daini Seikosha, Japan

[22] Filed: Sept. 11, 1975

[21] Appl. No.: 612,539

[30] Foreign Application Priority Data

Sept. 11, 1974 Japan ..... 49-104669

[52] U.S. Cl. ..... 58/126 R; 58/126 A; 58/126 D; 58/127 R; 116/129 F; D10/1

[51] Int. Cl.[2] ..... G04B 19/00

[58] Field of Search ..... 58/39.5, 125 R, 126 R, 58/126 A, 126 D, 127 R; 116/129 F; D10/1, 39

[56] References Cited

UNITED STATES PATENTS

D131,628 3/1942 Heinmuller ..... D10/1 X

FOREIGN PATENTS OR APPLICATIONS 827,266 4/1938 France ..... 58/126 R

*Primary Examiner*—Stanley J. Witkowski
*Attorney, Agent, or Firm*—Robert E. Burns; Emmanuel J. Lobato; Bruce L. Adams

[57] ABSTRACT

Visual time indicator suitable for incorporation in a watch or other time measuring devices comprising a dial made of a sheet of plate and concentrically divided into two zones: an inner zone and an outer zone, and hands to indicate hours, minutes and seconds. The hand for seconds has a long arm and a short arm which radially extend from a center of the dial to an opposite direction, respectively. The inner zone of the dial is provided with a graduation for the short arm of the second hand while the outer zone thereof is also provided with a progressive graduation for the long arm of the second hand, minute hand and hour hand. The graduation of the inner zone is started from a dial down position to a counterclockwise direction, whereby the graduation and the short arm of the second hand serves as a minute timer.

2 Claims, 1 Drawing Figure

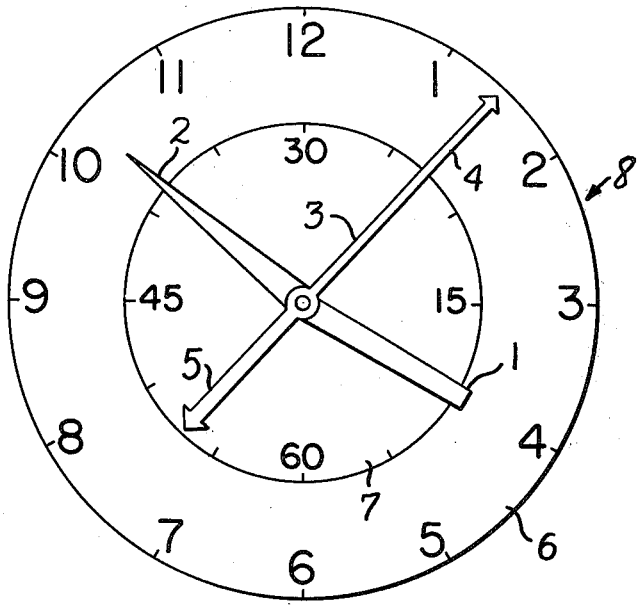
12
1
2
3
4
5
6
7
8
9
10
11
30
15
60
45
1
2
3
4
5
6
7
8

VISUAL TIME INDICATOR

BACKGROUND OF THE INVENTION

This invention relates to a visual time indicator suitable for incorporation in a watch or time measuring devices indicating hours, minutes and seconds and having a minute timer through which residual seconds remaining after passage seconds are easily read at a glance by means of a second hand which combines to indicate progressive seconds.

In a conventional chronograph, residual seconds time is indicated by the second hand with which are not combined any means to particularly indicate the residual seconds time, thereby resulting in error reading.

SUMMARY OF THE INVENTION

Therefore, it is an object of the present invention to provide an improved time indicator which represents a special visual effect to make a residual seconds time easily read at a glance, wherein hours, minutes and seconds are indicated by hour, minute and second hands, respectively.

It is another object of the present invention to provide an improved time indicator suitable for incorporation in a watch or other time measuring devices to constitute a minute timer.

BRIEF DESCRIPTION OF THE DRAWINGS

The sole FIGURE is a front view showing an embodiment of the present invention.

DESCRIPTION OF THE PREFERRED EMBODIMENT

The present invention will be fully described by way of an embodiment in connection with the accompanying drawings.

Watch hands comprise an hour hand 1, a minute hand 2 and a second hand 3. The second hand 3 includes a long - arm 4 and a short arm 5 which are extended from a center of a dial 8 in opposite directions, respectively.

The watch dial 8 is made of a sheet of plate and is concentrically divided into two zones. The outer zone of zones is provided with a progressive graduation 6 indicating hours, minutes and seconds. The inner zone is also provided with a graduation 7 for the short arm 5 of the second hand 3. The inner zone, the graduation 7 and the short arm of the second hand serve as a minute timer because the graduation is started from a dial down position corresponding to a six of the clock so as to be progressively, counterclockwise graduated. In case of a chronograph having a mechanism such as a return mechanism for making the second hand return to a zero position, when the long arm 4 of the second hand 3 is returned to the zero position, the short arm 5 of the second hand starting from the dial down position indicates the residual seconds remaining after passage seconds.

As mentioned above, the visual time indicator according to the present invention brings about advantages as follows: the residual seconds as well as hours, minutes and seconds can be correctly read at a glance, since the dial is concentrically divided into two zones to provide a minute timer; the inner zone is provided with the graduation or an indicating mark for the short arm of the second hand to indicate the residual seconds while the outer zone is provided with the graduation or indicating mark for hour, minute and second hands to indicate hours, minutes and seconds. Therefore, it is available to be used in the chronograph or the like.

What is claimed is:

1. A visual time indicator suitable for incorporation in a watch or other time measuring devices comprising: a dial made of a sheet of plate and concentrically divided into two zones including an inner zone and an outer zone which has a progressive graduation for hours, minutes and seconds; and hour, minute and second hands to indicate said progressive graduation, said second hand having a short arm and a long arm which extend from the center of said dial in opposite directions, said short arm indicating a graduation provided in said inner zone, said graduation starting from a dial down position and being progressively graduated in a counterclockwise direction, whereby said graduation of the inner zone of the dial and the short arm of the second hand constitute a minute timer.

2. A visual time indicator according to claim 1, wherein said minute timer comprising said graduation of the inner zone of the dial and said short arm of the second hand presents a residual seconds remaining after passage seconds indicated by the long arm of said second hand.

* * * * *